US010793984B2

(12) United States Patent
Ballone et al.

(10) Patent No.: US 10,793,984 B2
(45) Date of Patent: Oct. 6, 2020

(54) NON-IRON FABRICS AND GARMENTS, AND A METHOD OF FINISHING THE SAME

(71) Applicant: PVH Corp., New York, NY (US)

(72) Inventors: Jeanine Ann Ballone, New York, NY (US); Syed Naved Hussain, Gazipur (BD); Nauman Hakeem, Gazipur (BD); Delwar Hossain, Gazipur (BD)

(73) Assignee: PVH Corporation, New York, NY (US)

( * ) Notice: Subject to any disclaimer, the term of this patent is extended or adjusted under 35 U.S.C. 154(b) by 0 days.

(21) Appl. No.: 16/323,067

(22) PCT Filed: Aug. 4, 2016

(86) PCT No.: PCT/US2016/045530
§ 371 (c)(1),
(2) Date: Feb. 4, 2019

(87) PCT Pub. No.: WO2018/026368
PCT Pub. Date: Feb. 8, 2018

(65) Prior Publication Data

US 2019/0177894 A1 Jun. 13, 2019

(51) Int. Cl.
*D06B 7/00* (2006.01)
*D06B 3/10* (2006.01)
(Continued)

(52) U.S. Cl.
CPC ..... *D06B 7/00* (2013.01); *D06B 3/10* (2013.01); *D06M 15/19* (2013.01); *D06M 15/39* (2013.01); *D06M 2200/20* (2013.01)

(58) Field of Classification Search
CPC ..... D06B 7/00; D06B 3/10; D06M 15/19; D06M 2101/06; D06M 2200/45; D06M 2200/20
See application file for complete search history.

(56) References Cited

U.S. PATENT DOCUMENTS 4,936,865 A * 6/1990 Welch ..... D06M 13/192 8/120
5,858,021 A 1/1999 Sun et al.
(Continued)

FOREIGN PATENT DOCUMENTS

CN 1766223 A 5/2006
CN 101111633 A 1/2008
(Continued)

OTHER PUBLICATIONS

European Supplemental Search Report in counterpart EP 16911773, dated Mar. 5, 2020 (11 pages).

*Primary Examiner* — Eisa B Elhilo
(74) *Attorney, Agent, or Firm* — Venable LLP

(57) ABSTRACT

The present disclosure relates to a method of finishing non-iron fabrics, and the non-iron fabrics made by this method. This method includes the steps of mercerizing a fabric without liquid ammonia; curing the fabric by applying a low temperature, low formaldehyde curing resin and dry cross linking it; and massaging the fabric using an air blast textile finishing machine. The non-iron fabrics (and garments) produced according to this method have an improved durable press rating and reduced formaldehyde content or are even formaldehyde free when compared to similar products finished according to conventional liquid ammonia moisture-cure processing.

22 Claims, 2 Drawing Sheets

(51) Int. Cl.
*D06M 15/19* (2006.01)
*D06M 15/39* (2006.01)

(56) References Cited

U.S. PATENT DOCUMENTS

| | | | | |
|---|---|---|---|---|
| 6,042,767 | A | 3/2000 | Hashemzadeh et al. | |
| 6,068,689 | A | 5/2000 | Bjur et al. | |
| 6,171,441 | B1 | 1/2001 | Phillips et al. | |
| 6,284,348 | B1 | 9/2001 | Suzuki et al. | |
| 6,488,809 | B1 | 12/2002 | Phillips et al. | |
| 6,620,293 | B2 | 9/2003 | Sears et al. | |
| 6,835,828 | B2 | 12/2004 | Sears et al. | |
| 7,018,511 | B2 | 3/2006 | Sears et al. | |
| 7,090,702 | B2 | 8/2006 | Badiali et al. | |
| 7,195,695 | B2 | 3/2007 | Sears et al. | |
| 7,288,167 | B2 | 10/2007 | Sears et al. | |
| 7,578,017 | B2 | 8/2009 | Decouvelaere | |
| 7,841,022 | B2 | 11/2010 | Chang | |
| 9,181,652 | B2 | 11/2015 | Harrison | |
| 9,328,459 | B2 | 5/2016 | Weerawama | |
| 2002/0137414 | A1* | 9/2002 | Lack | D06M 13/432 442/85 |
| 2003/0226346 | A1 | 12/2003 | Badiali et al. | |
| 2005/0278868 | A1 | 12/2005 | Fumisi et al. | |
| 2006/0043328 | A1* | 3/2006 | Hunt | D06M 15/29 252/8.91 |
| 2006/0090266 | A1* | 5/2006 | Gardner | D06M 13/192 8/115.51 |
| 2006/0144532 | A1 | 7/2006 | Shaver et al. | |
| 2006/0156476 | A1 | 7/2006 | Arnold et al. | |
| 2006/0174419 | A1 | 8/2006 | Decouvelaere | |
| 2008/0115289 | A1 | 5/2008 | Stackhouse | |
| 2015/0259843 | A1 | 9/2015 | Goenka | |

FOREIGN PATENT DOCUMENTS

| | | | |
|---|---|---|---|
| CN | 101144193 | A | 3/2008 |
| CN | 101161904 | A | 4/2008 |
| CN | 101210360 | A | 7/2008 |
| CN | 101358429 | A | 2/2009 |
| CN | 101392425 | A | 3/2009 |
| CN | 101403157 | A | 4/2009 |
| CN | 100535227 | C | 9/2009 |
| CN | 100554559 | C | 10/2009 |
| CN | 101624736 | A | 1/2010 |
| CN | 101748595 | A | 6/2010 |
| CN | 101768852 | A | 7/2010 |
| CN | 201574308 | U | 9/2010 |
| CN | 101858020 | A | 10/2010 |
| CN | 101979753 | A | 2/2011 |
| CN | 102011243 | A | 4/2011 |
| CN | 102051720 | A | 5/2011 |
| CN | 102121205 | A | 7/2011 |
| CN | 102199886 | A | 9/2011 |
| CN | 102433678 | A | 5/2012 |
| CN | 102505404 | A | 6/2012 |
| CN | 102926071 | A | 2/2013 |
| CN | 102926215 | A | 2/2013 |
| CN | 102936771 | A | 2/2013 |
| CN | 102965870 | A | 3/2013 |
| CN | 102995444 | A | 3/2013 |
| CN | 103255613 | A | 8/2013 |
| CN | 103306141 | A | 9/2013 |
| CN | 103409983 | A | 11/2013 |
| CN | 103437172 | A | 12/2013 |
| CN | 103469457 | A | 12/2013 |
| CN | 103541167 | A | 1/2014 |
| CN | 103668937 | A | 3/2014 |
| CN | 103862827 | A | 6/2014 |
| CN | 103966871 | A | 8/2014 |
| CN | 104047159 | A | 9/2014 |
| CN | 104153139 | A | 11/2014 |
| CN | 104233598 | A | 12/2014 |
| CN | 104233600 | A | 12/2014 |
| CN | 104233603 | A | 12/2014 |
| CN | 104233770 | A | 12/2014 |
| CN | 104264333 | A | 1/2015 |
| CN | 104264334 | A | 1/2015 |
| CN | 104264357 | A | 1/2015 |
| CN | 104264478 | A | 1/2015 |
| CN | 104278413 | A | 1/2015 |
| CN | 104328566 | A | 2/2015 |
| CN | 104358002 | A | 2/2015 |
| CN | 104358015 | A | 2/2015 |
| CN | 104372550 | A | 2/2015 |
| CN | 104420156 | A | 3/2015 |
| CN | 104420173 | A | 3/2015 |
| CN | 104480695 | A | 4/2015 |
| CN | 104593972 | A | 5/2015 |
| CN | 104611873 | A | 5/2015 |
| CN | 104631007 | A | 5/2015 |
| CN | 104746274 | A | 7/2015 |
| CN | 104762727 | A | 7/2015 |
| CN | 104762785 | A | 7/2015 |
| CN | 104790147 | A | 7/2015 |
| CN | 104831516 | A | 8/2015 |
| EP | 0923657 | B1 | 6/1999 |
| EP | 0945539 | A1 | 9/1999 |
| EP | 1023488 | A1 | 8/2000 |
| EP | 1651807 | A2 | 5/2006 |
| EP | 1536707 | B1 | 6/2006 |
| EP | 1688523 | A1 | 8/2006 |
| EP | 1905888 | A1 | 4/2008 |
| FR | 1390468 | A | 2/1964 |
| GB | 2466068 | A | 6/2010 |
| ID | 22776 | A | 12/1999 |
| WO | 98/10132 | A1 | 3/1998 |
| WO | 99/16961 | A1 | 4/1999 |
| WO | 00/68493 | A1 | 11/2000 |
| WO | 02/27092 | A1 | 4/2002 |
| WO | 03/023129 | A1 | 3/2003 |
| WO | 03/099047 | A2 | 12/2003 |
| WO | 2005019516 | A2 | 3/2005 |
| WO | 2006079578 | A1 | 8/2006 |
| WO | 2008059469 | A2 | 5/2008 |
| WO | 2014005245 | A1 | 1/2014 |
| WO | 2014020503 | A1 | 2/2014 |
| WO | 2016024047 | A1 | 2/2016 |

* cited by examiner

FABRIC FINISHING (PRIOR ART)

NON-IRON FABRICS AND GARMENTS, AND A METHOD OF FINISHING THE SAME

FIELD OF THE INVENTION

The present invention relates to non-iron fabrics and garments, and a method of finishing the same. These non-iron fabrics and garments have an improved durable press rating and reduced formaldehyde content compared to similar products made using conventional methods, and are not made using liquid ammonia moisture-cure processing. Instead, the non-iron fabrics and garments are made by mercerizing without liquid ammonia, dry cross linking and massaging the fabric with an air blast textile finishing machine.

BACKGROUND OF THE INVENTION

As textile goods, such as fabrics and garments defined below, are worn and laundered, undesired creases and wrinkles will appear on them. In particular, for cellulosic-based garments, such use causes noticeably visible creases and wrinkles, creating an undesirable look and finish. Consumers may attempt to remove the undesired creases and wrinkles, for example, by tumble-drying, ironing, or pressing, but these methods are often imperfect and require time and effort. Because frequent or difficult wrinkling and creasing leads to consumer dissatisfaction, manufacturers and designers of textile goods have sought means to give the goods a "durable press," meaning the ability to avoid wrinkle/crease formation and/or the ability to quickly remove wrinkles and creases with minimal work.

"Fabric" includes any cellulosic material, including but not limited to cotton, cotton blend, linen, ramie, rayon, viscose, wool, silk, jute, cupro, polynosic, polyammide, Tencel, Lyocell, Modal, nylon, acrylic, and hemp, and combinations thereof. Preferably, the fabric may be cotton or cotton blend. "Garment" refers to any item of clothing or bedding that is made from fabric. For example, a garment includes, but is not limited to, a shirt, skirt, pants, shorts, jacket, tie, sheet, pillow case and a dress.

Durable press is well-known in the art as a measure of a fabric or garment's ability to retain substantially its initial shape, including, but not limited to, flat seams, pressed creases and wrinkle-free appearance during the course of use and after laundering. Durable press and, more generally, wrinkle resistance, in the textile industry can be measured according to AATCC-143 (for garments) and AATCC-124 (for finished fabric). For example, AATCC-124 is a rating of smoothness appearance of fabrics and ranges from 1 to 6. This test method is designed to evaluate the smoothness appearance of flat fabric specimens after repeated home laundering.

"Non-iron" is a term generally understood by one of ordinary skill in the art and which refers to an item composed of various fibers that are crease- and wrinkle-resistant and, preferably, do not require ironing. Therefore, a "non-iron fabric" and a "non-iron garment" is a fabric or garment, respectively, that is crease- and wrinkle-resistant and, preferably, does not require ironing.

Conventional methods of finishing easy care, wrinkle-free, non-iron, or super non-iron fabrics and garments typically use liquid ammonia in a step of mercerization. The use of liquid ammonia is known to impart improved easy care properties to the fabric.

Application of a chemical coating, e.g., a resin, to the textile good is another way to realize improved wrinkle/crease resistance, dimensional stability and ease of care of the good, that is, improved durable press. These chemical coatings often incorporate a cross-linking agent that cross-links, typically in the presence of a catalyst and sometimes heat, the cellulose in the fibers of the textile good.

Conventionally, formaldehyde or formaldehyde derivatives have been used as the cross-linking agent for improving durable press. Formaldehyde cross-linking agents are attractive because they are effective and inexpensive, and help keep the fibers of the textile good in place, thereby reducing wrinkling and creasing.

FIG. 1 shows an example of a conventional method for finishing a non-iron fabric, which incorporates a step of liquid ammonia mercerization and the application of a formaldehyde containing resin. In particular, FIG. 1 is a flow chart of conventional liquid ammonia moisture-cure (LAMC) processing for finishing a non-iron fabric such as cotton. This LAMC processing includes the following steps: 1) singeing the fabric to obtain a singed fabric; 2) desizing the singed fabric to obtain a desized fabric; 3) impregnating the desized fabric to obtain an impregnated fabric; 4) hot washing the impregnated fabric to obtain a hot washed fabric; 5) width setting the hot washed fabric to obtain a width set fabric; 6) caustic mercerizing the width set fabric to obtain a caustic mercerized fabric; 7) liquid ammonia (LA) mercerizing the caustic mercerized fabric to obtain a double mercerized fabric; 8) curing the double mercerized fabric, including the steps of: a) applying resin to obtain a resin-treated fabric; and b) moisture cross linking the resin-treated fabric to obtain a LAMC fabric; 9) washing the LAMC fabric to obtain a washed LAMC fabric; 10) softening the washed LAMC fabric to obtain a softened LAMC fabric; and 11) sanforizing the softened LAMC fabric to obtain a finished LAMC fabric. These steps may be accomplished using techniques and machinery conventionally known in the art.

Singeing (step 1 of FIG. 1) is the process of burning off unwanted hairs and fibers to produce a smoother fabric. With fabrics other than cotton, alternative methods of smoothing the fabric may be used as step 1, such as plucking or other means of extracting hairs or fibers. In the method according to FIG. 1, singeing the fabric is performed at 70 meters/minute (hereinafter referred to as "m/min").

Desizing (step 2 of FIG. 1) is the process of removing sizing agent that was previously added to produce a strong warp yarn for weaving. In the method according to FIG. 1, desizing is performed at a speed of 70 m/min and a temperature of 70° C.

Impregnating (step 3 of FIG. 1) the desized fabric is the process of soaking, saturating, and swelling the fabric. In the method according to FIG. 1, impregnation is performed over the course of 2.0 hours at 35° C.-40° C.

Hot washing or scouring (step 4 of FIG. 1) is performed to remove sizing agents. In this step, the fabric is washed in the presence of a solvent. Typically, the solvent used for hot washing is hot water or steam, or an alkali like sodium hydroxide. In the method according to FIG. 1, hot washing is performed with water at a speed of 40 m/min and a temperature of 90° C.

Width setting (step 5 of FIG. 1) is the process of equalizing the fabric at a width required for mercerizing. Preferably, a stenter is used for width setting. In the method according to FIG. 1, width setting is performed using a stenter at a speed of 50 m/min and a temperature of 100° C.-135° C.

Mercerizing is a caustic application generally understood by one of ordinary skill in the art to be a process of applying a chemical to flatten the fibers making up the fabric. Mercerization alters the chemical structure of the fiber by causing swelling of the cell wall of the fiber, which produces an increase in the surface area and reflectance, and imparts a softer feel to the fiber. By incorporating the step of mercerizing in the treatment of, for example, cotton and cotton blends, the fabric has improved luster, wettability, covering effect for dead cotton, dimensional stability and dyeing efficiency. These improvements also increase the durable press rating of the fabric.

In FIG. 1, there are two mercerizing steps. First, caustic mercerizing (step 6 of FIG. 1) is performed using a caustic soda as the mercerizing agent, 28 baume at 50 m/min and 40° C. The caustic soda causes contraction and swelling of the fibers in the fabric. As the fibers swell, they become translucent and increase in tensile strength; and the bean-like section of the fiber becomes elliptic and then circular, which better reflects light and increases the luster of the fabric.

Next, liquid ammonia mercerizing (step 7 of FIG. 1) is performed using liquid ammonia as a mercerizing agent. Liquid ammonia mercerization is a treatment performed at low temperatures, i.e., −33° C. to −35° C., for a short period of time, e.g., within 30 seconds. When cellulosic fiber, such as cotton, is immersed in liquid ammonia, the cellulose swells in a manner similar to that when cellulosic fiber is immersed in an aqueous caustic soda solution. Specifically, the typical bean shape of a cellulosic fiber becomes more cylindrical, and its walls thicken. In this condition, increased amounts of dyes and resins may be absorbed by the fibers. The process results in a smoother surface of the fabric; improved absorbency, strength and luster; a soft touch; and improved durable press.

Curing is a process of applying a resin, or resin finishing agent, to a fabric in which appropriate conditions are applied to effect a chemical reaction. The resin generally includes a formaldehyde base. While resin application has some disadvantages when used with cellulosic fibers (e.g., loss of strength, variations in shade, reduced whiteness, and formaldehyde content), the advantages of resin finished fabric over fabrics not finished with resin include: (1) improved dimensional stability and shape retention; (2) decreased tendency to crease; (3) easier to iron; (4) softer and smoother feel; (5) better appearance and durability; (6) less variation in shade; (7) improved wet fastness; and (8) decreased tendency to pill, especially with fiber blends.

After applying the resin, the resin-treated fabric is generally heat treated, either by subjecting it to high temperatures for short times (flash curing) or to low temperatures for longer periods (e.g., moist curing). In conventional processes, after liquid ammonia mercerization, resin is applied and the fabric is treated by moist cross linking. In conventional moist cross linking, the fabric is cured in a moist, partially swollen state (about 6-12% residual moisture). The fabric is padded with a liquid containing a mineral acid catalyst, such as sulfuric acid, in addition to the resin and the fabric is subsequently dried to a residual moisture of about 6-12%. The fabric is then left in at a controlled temperature of about −2° C. to 30° C. for moist cross linking for about 24 hours. After being batched for one or two days, the fabric is washed, neutralized, and dried, and then usually treated with handle finishing agent.

In particular, resin application (step 8*a* of FIG. 1) is performed in a stenter at 20 m/min and 90° C.-100° C. (12% moisture) and includes 150-180 grams/liter (herein after referred to as "gpl") resin, 22-25 gpl catalyst (for example, $H_2SO_4$), 20 gpl polyethylene dispersion, and 1 gpl wetting agent with a pick-up ("PU") at 65%.

The second part of conventional curing, i.e., moist cross linking (step 8*b* of FIG. 1), is accomplished by cold impregnation for 24 hours at a low temperature of about 23° C.-27° C.

Washing (step 9 of FIG. 1) involves placing the LAMC fabric in a solvent known for use in the art, preferably water, to neutralize any chemicals and remove any unfixed resin and/or formaldehyde. Washing may be performed using any machine conventionally used in the art for washing fabric or by hand. In the method according to FIG. 1, washing is performed at 40 m/min and 30° C.-40° C.

Softening (step 10 of FIG. 1) involves processing the washed LAMC fabric in any machine preferably used for softening such as a stenter. While softening, the fabric is generally treated with a top finishing coat containing an elastomer, a polyethylene dispersion, and a wetting agent. In the method according to FIG. 1, softening is performed using a stenter at 50 m/min and 120° C. and the fabric is treated with a top finishing coat containing 10 gpl elastomer in a macro emulsion, and 20 gpl polyethylene dispersion.

Sanforizing (step 11) is generally understood by one of ordinary skill in the art as a process to control shrinkage of the fabric. In the method according to FIG. 1, sanforizing is performed at a speed of 50 m/min and at a temperature of 85° C.

Though producing excellent non-iron fabrics and garments, using liquid ammonia is harsh on fabric durability and color stability. Non-iron fabrics and garments, for example, non-iron shirts, made with liquid ammonia mercerization may be thicker, stiffer, and scratchier than those made without liquid ammonia mercerization. The use of liquid ammonia mercerization may also cause manufacturing problems. For at least these reasons, eliminating liquid ammonia mercerization is desirable.

Using formaldehyde or formaldehyde derivatives has several drawbacks, such as degrading the cellulose fibers due to the acid degradation by the catalyst, which in turn causes the treated fabric or garment to lose strength. Residual formaldehyde may irritate the skin when a treated garment is worn. Thus, reducing or eliminating the use of formaldehyde is desirable.

Accordingly, there is a need in the industry for an improved method for finishing non-iron fabrics and garments without using liquid ammonia and having reduced amounts of formaldehyde or being substantially free of formaldehyde.

SUMMARY OF THE INVENTION

An improved method of finishing a non-iron fabric is disclosed including the steps of: a) mercerizing a fabric without liquid ammonia; b) curing the mercerized fabric by applying a reduced formaldehyde low temperature curing resin and dry cross linking the resin treated fabric; and c) massaging the cured fabric using an air blast textile finishing machine to produce the non-iron fabric. The non-iron fabric and garments made with this improved method have a durable press rating of at least about 2.5, more preferably about 3.0, and most preferably of about 3.5.

The improved method for finishing a non-iron fabric may also include singeing, desizing, impregnating, hot washing and/or width setting before the step of mercerizing the fabric. The improved method may also include width setting and/or sanforizing after massaging the fabric using an air blast textile finishing machine. Any of these optional steps may also be repeated.

In other combinations, the method for finishing a non-iron fabric may further include washing the cured fabric to obtain a washed fabric and/or softening the washed fabric, after curing the mercerized fabric and before massaging the cured fabric using an air blast textile finishing machine.

A non-iron fabric is also disclosed made of a cellulosic material that has a durable press rating of at least about 3.0, and has a formaldehyde content of less than about 25 ppm. The non-iron fabric may also be substantially free of formaldehyde. By substantially free it is meant that formaldehyde is not detectable using conventional measurement techniques, i.e., the formaldehyde content is less than about 9-10 ppm. In addition, a non-iron garment made of this non-iron fabric is disclosed.

Further, a non-iron fabric and garment made by the improved method are disclosed.

DETAILED DESCRIPTION

Generally, disclosed herein is a non-iron fabric, an improved method of finishing a non-iron fabric and a non-iron fabric finished in accordance with the improved method. That improved method includes mercerizing a fabric without liquid ammonia. After mercerizing, the fabric is cured by first applying a low temperature curing resin to the mercerized fabric and then dry cross linking the resin treated fabric. The cured fabric is massaged using an air blast textile finishing machine to produce the non-iron fabric.

Figure 2:
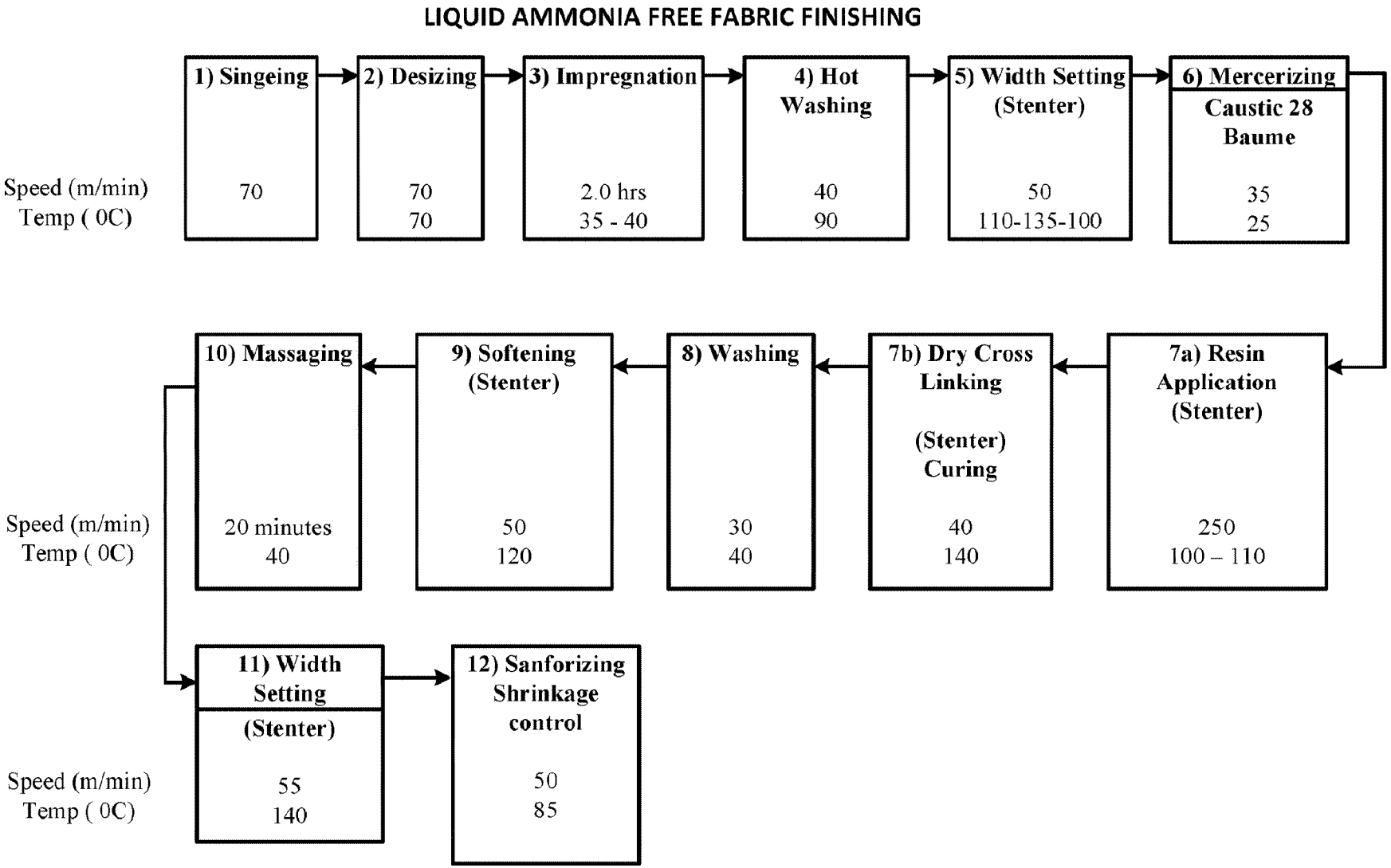
FIG. 2 is a flow chart depicting an improved method of the present invention for finishing non-iron fabric.

An embodiment of the improved method of the present invention is shown in FIG. 2. FIG. 2 includes the steps of: 1) singeing the fabric; 2) desizing the singed fabric; 3) impregnating the desized fabric; 4) hot washing the impregnated fabric in hot water; 5) width setting the hot washed fabric. Step 5 (width setting) is followed by: 6) mercerizing the width set fabric with caustic 28 baume at a pH of 5.5-6.5; 7a) applying a low temperature curing resin to the mercerized fabric; 7b) dry cross linking the resin-treated fabric in a stenter; 8) washing the cured fabric; 9) softening the washed and cured fabric in a stenter; 10) massaging the softened and cured fabric in an air blast textile finishing machine, for example, a Biancalani AIRO®; 11) width setting the massaged fabric in a stenter; and 12) sanforizing the set fabric to obtain a non-iron fabric. One of ordinary skill in the art will understand how to adjust the procedure and parameters discussed therein, e.g., dosage of chemicals and speed of the machine, depending on the fabric.

As evident from a comparison of FIG. 1 and FIG. 2, the initial steps of the processes, that is, steps 1-5, are substantially similar, except as explained below. In addition, steps 8, 9 and 12 of FIG. 2 are substantially similar to steps 9, 10 and 11 of FIG. 1, respectively, except as explained below.

Figure 1:
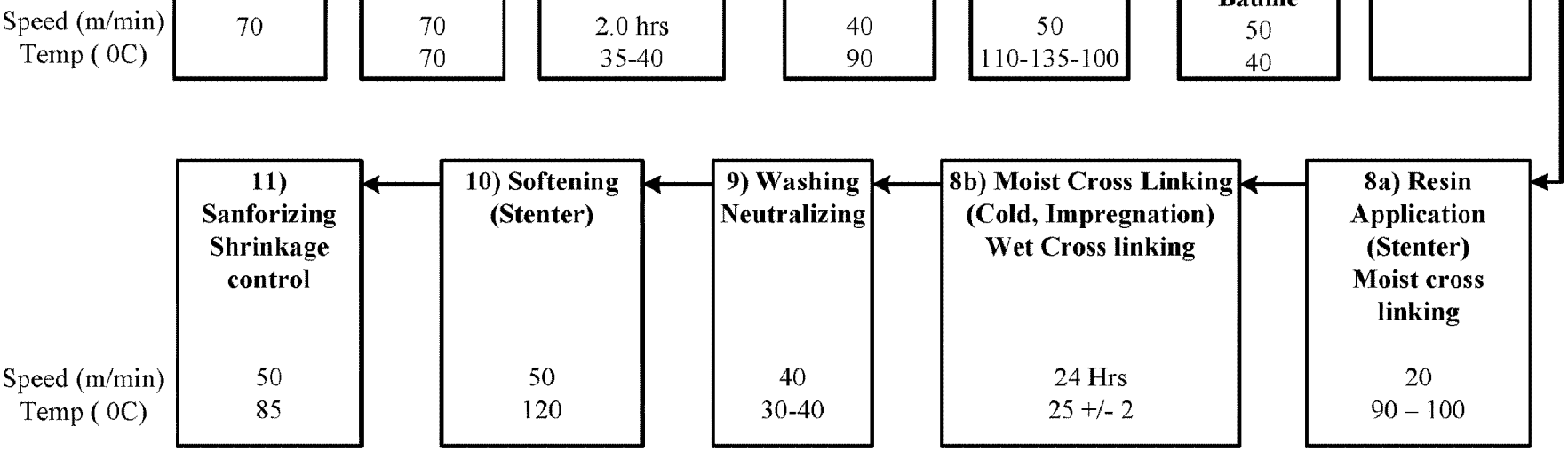
FIG. 1 is a flow chart depicting an example of conventional liquid ammonia moisture-cure processing for finishing non-iron fabric.

The improved method of the present invention does not include steps 7 (liquid ammonia mercerizing) and 8b (cold impregnation with moist cross linking) of FIG. 1. In addition, while both processes include steps of caustic mercerization and resin application, the details of these steps vary significantly between conventional LAMC processing (FIG. 1) and the improved method of the present invention (FIG. 2). Further still, FIG. 2 includes a step of massaging the cured fabric in an air blast textile finishing machine.

It should be understood that the method of this invention must include the steps of: a) mercerizing a fabric without liquid ammonia to obtain a mercerized fabric (step 6 of FIG. 2); b) Curing the mercerized fabric, including the steps of: applying low temperature curing resin to the mercerized fabric to obtain a resin treated fabric (Step 7*a* of FIG. 2); and dry cross linking the resin treated fabric to obtain a cured fabric (Step 7*b* of FIG. 2); and massaging the cured fabric using an air blast textile finishing machine to produce the non-iron fabric (Step 10 of FIG. 2). The other steps set forth in FIG. 2 are optional and their inclusion provides for preferable embodiments of the invention.

The durable press rating achieved by the improved method of the present invention is about 2.5 to about 4.2, preferably, about 3.0 to about 4.0, more preferably, about 3.25 to about 4.0, and still more preferably about 3.5 to about 4.0, and most preferably about 3.5. In an embodiment, the non-iron garment has a durable press rating of greater than about 2.5, preferably greater than about 3.0, still more preferably at least about 3.5, and most preferably about 4.0.

In an embodiment, the non-iron fabric has a durable press rating of at least about 2.5 after three washes, preferably at least about 3.0 after three washes, more preferably at least about 3.5 after three washes and most preferably about 3.5 after three washes. In another embodiment, the non-iron garment of the present invention will have a durable press rating of at least about 2.5 after three washes, preferably at least about 3.0 after three washes, more preferably at least about 3.5 after three washes, and more preferably about 4.0 after three washes.

In a certain embodiment, the non-iron fabric or non-iron garment will have a durable press rating of about 2.5 to about 3.8 after five washes, preferably about 3.0 to about 3.8 after five washes, and more preferably about 3.5 after five washes. Significantly, a non-iron fabric of this invention is achieved with the above-noted durable press ratings without the use of liquid ammonia. In addition, the non-iron fabric of the invention having the above-noted durable press ratings is also advantageously prepared such that it has significantly reduced residual formaldehyde content compared to conventional LAMC processing or even more preferably is substantially free of residual formaldehyde.

The non-iron fabric and garment made by a method of the present disclosure have a durable press rating that is the same or better than fabric processed according to conventional LAMC processing, but the non-iron fabrics and garments finished in accordance with the present disclosure are easier to handle, softer, more flexible, have a better hand feel and have a reduced risk of variation in fabric color for woven goods, in particular, with 100% cotton, because of the continuous quick curing time.

In an embodiment, "non-iron fabric" encompasses easy care, wrinkle-resistant, non-iron and super non-iron fabrics, preferably, "non-iron fabric" encompasses wrinkle-resistant, non-iron and super non-iron fabrics, more preferably, "non-iron fabric" encompasses non-iron and super non-iron fabrics.

Singeing, when used, in accordance with the present invention is substantially similar to the singeing step described in the background section (e.g., step 1 of FIG. 1), except that the parameters and details differ as follows. In a certain embodiment of the invention, singeing is performed at a speed of about 60 meters/minute (hereinafter referred to as "m/min") to about 80 m/min, preferably about 65 m/min to about 75 m/min, and more preferably about 70 m/min.

Desizing, when used, in accordance with the present invention is substantially similar to the desizing step described in the background section (e.g., step 2 of FIG. 1), except that the parameters and details differ as follows. In a certain embodiment, desizing is performed at a speed of about 60 m/min to about 80 m/min, preferably about 65 m/min to about 75 m/min, and more preferably about 70 in/min, and at a temperature of about 55° C. to about 85° C., preferably about 60° C. to about 80° C., more preferably about 65° C. to about 75° C., and most preferably about 70° C. In this process for yarn dyed goods, pick-up ("PU") should be about 70% to about 100%, preferably about 80% to about 100%, and more preferably about 90% to about 100%.

Impregnation, when used, in accordance with the present invention is substantially similar to the impregnation step described in the background section (e.g., step 3 of FIG. 1), except that the parameters and details differ as follows. In a certain embodiment, impregnation is performed over the course of about 1.0 hour to about 3.0 hours, preferably about 1.5 hours to about 2.5 hours, and more preferably about 2.0 hours, and at a temperature of about 20° C. to about 55° C., preferably about 25° C. to about 50° C., more preferably about 30° C. to about 45° C., and most preferably about 35° C. to about 40° C.

Hot washing, when used, in accordance with the present invention is substantially similar to the hot washing step described in the background section (e.g., step 4 of FIG. 1), except that the parameters and details differ as follows. In a certain embodiment, hot washing is performed at a speed of about 30 m/min to about 50 m/min, preferably about 35 m/min to about 45 m/min, and more preferably about 40 n/min, and at a temperature of about 75° C. to about 105° C., preferably about 80° C. to about 100° C., more preferably about 85° C. to about 95° C., and most preferably about 90° C.

Width setting, when used, in accordance with the present invention is substantially similar to the width setting step described in the background section (e.g., step 5 of FIG. 1), except for the following details and that, unlike in the prior art (FIG. 1), width setting may be performed both before mercerizing and again after massaging the fabric using an air blast textile finishing machine. In addition, the parameters differ as follows. In an embodiment of the invention, width setting is performed at a speed of about 40 m/min to about 65 m/min, preferably about 45 m/min to about 60 m/min, and more preferably about 50 m/min to about 55 m/min. Width setting before mercerizing may preferably be performed at a temperature of about 90° C. to about 150° C., preferably about 95° C. to about 145° C., and more preferably about 100° C. to about 135° C.

Mercerizing is generally described above in the background section. However, mercerizing in accordance with the present invention is performed without addition of liquid ammonia. As shown in FIG. 1, in conventional LAMC processing, there often are two mercerizing steps: caustic mercerizing followed by liquid ammonia mercerizing. The method of the present invention has only one mercerizing step and the entire finishing process is performed without the addition of and in the absence of, liquid ammonia.

The embodiment shown in FIG. 2 includes a mercerizing step 6 using a caustic 28-30 baume (approximately 270-330 grams/liter (herein after referred to as "gpl")), and preferably caustic soda 28 baume. This also may be referred to as caustic mercerization.

In a preferred embodiment, the mercerizing step may be performed at a speed of about 15 m/min to about 50 m/min, preferably about 25 m/min to about 45 m/min, more preferably about 30 m/min to about 40 m/min, and most preferably about 35 m/min. In another preferred embodiment, the mercerizing step may be performed and controlled at a pH of about 4.5 to about 7.5, preferably about 5 to about 7, and more preferably about 5.5 to about 6.5. In a further preferred embodiment, the mercerizing step may be performed at a temperature of about 12° C. to about 30° C., preferably about 15° C. to about 25° C., and more preferably about 17° C. to about 25° C.

Any chemical known in the art for mercerizing may be used in accordance with the present invention. For example, in the improved method of FIG. 2, sodium hydroxide is used.

A mercerizing wetting agent may also be added to maintain an alkaline environment and improve uniformity. Any known mercerizing wetting agent that is stable in caustic baume, preferably stable in at least caustic 28-30 baume, may be used. Upon completion of the mercerizing step, the alkaline mercerizing wetting agent is neutralized by means of diluted acid solution, such as an organic acid or acetic acid. An exemplary wetting agent may be a non-ionic surfactant such as RUCOWET® VI, available from Rudolf Pakistan.

In a certain embodiment, mercerization may be performed under tension. In another preferred embodiment, the mercerizing step may be performed using chain mercerization, which is a process using optimum tension control whereby the fibers achieve excellent luster. Processing by chain mercerization helps to control the width of the fabric.

After mercerization, the mercerized fabric is cured. The curing step of the present invention includes application of a low temperature curing resin (for example, step 7*a*), dry cross linking (for example, step 7*b*), and is complete in a matter of minutes, rather than 24 hours. Thus, unlike the conventional LAMC method, the method of the present invention is highly advantageous because it can be run continuously.

Any machine known for use in curing may be used in accordance with the present invention, though preferably curing may be practiced using a stenter. The machine may consist of a padding mangle, weft straighter, and hot flow chambers with an air circulation system and moisture controller. The speed of the machine depends on the temperature setting in individual hot flow chambers and the number of chambers in the machine.

Curing may be accomplished in one step, e.g., one pass through a stenter during which resin application and dry cross linking is achieved, or in multiple steps. When curing is accomplished in two steps, the steps are continuous and include: 1) applying a low temperature curing resin, and preferably drying, the mercerized fabric to obtain a resin-treated fabric; and 2) dry cross linking the resin-treated fabric to obtain a cured fabric. The same or different machines may be used for the two separate steps, i.e., the resin application step and the dry cross linking step. That machine may be any conventional curing machine, and, preferably, a stenter for either or both steps. Thus, after being padded by the stenter during resin application, the fabric may be dried on the stenter and then cross linked in a curing machine, in a second pass on the stenter, or on the stenter immediately after drying (flash curing process). In an embodiment thereof, in the step of applying low temperature curing resin and drying, a stenter is used and the fabric; i) passes through a chemical trough containing the low temperature curing resin; ii) passes through a padding mangle, which removes any excess chemicals (i.e., padding); iii) is processed by a weft straightener; and, lastly, iv) is dried. The flow of hot air is used to dry the fabric.

Whether accomplished in one step or in multiple steps, curing in accordance with the present invention is a continuous process wherein the fabric does not need to be left in the stenter for impregnation. By curing in this way, the non-iron fabric, and any non-iron garment made from that fabric, has improved hand feel, color stability, flexibility and dimensional stability.

In a certain embodiment, curing, as a one step process, is performed at a speed of about 25 m min to about 60 m/min, preferably about 30 m/min to about 55 m/min, more preferably about 40 m/min to about 50 m/min. Curing may take less than about 1 hour to complete, preferably about 10 seconds to about 30 minutes, more preferably about 20 seconds to about 10 minutes, more preferably about 20 seconds to about 5 minutes, and most preferably about 30 seconds to about 2 minutes.

In a certain embodiment, applying the low temperature curing resin, or "resin application", is performed at a speed of about 35 m/min to about 65 m/min, preferably about 40 m/min to about 60 m/min, and more preferably about 50 m/min. The resin is applied at room temperature (about 25° C. to about 35° C.) and then the temperature is elevated to about 85° C. to about 125° C., preferably about 90° C. to about 120° C., more preferably about 95° C. to about 115° C., and most preferably about 100° C. to about 110° C.

In other certain embodiments, dry cross linking is performed at a speed of about 30 m/min to about 50 m/min, preferably about 35 m/min to about 45 m/min, and more preferably about 40 m/min; at a temperature of about 120° C. to about 160° C., preferably about 130° C. to about 150° C., more preferably about 135° C. to about 145° C., and most preferably about 140° C.; and for about 10 seconds to about 30 minutes, preferably for about 20 seconds to about 10 minutes, more preferably for about 25 seconds to about 2 minutes, more preferably for about 30 seconds to about 50 seconds, and most preferably for about 40 seconds.

A low temperature curing resin is used to achieve an improved degree of smoothness and appearance rating (e.g., whiteness and brightness) with minimal loss of tensile and tear strength and minimal formaldehyde content in the fabric. A low temperature curing resin is a resin which cross links at the (low) temperatures stated in the preceding paragraph, and contains at least one cross linking agent, which typically has a formaldehyde base and which preferably contains low amounts of uncombined formaldehyde (less than about 0.1%). The low temperature curing resin may also contain at least one catalyst, at least one additive, and/or at least one surfactant.

The cross linking agent of the curing resin is used for finishing. It alters woven fabric composed of cellulosic fibers and blends of cellulosic fibers with synthetic fibers in such a way that the resulting textiles are easier to care for. Cross linking agents may be categorized into two groups: self-cross linking agents and reactant cross linking agents. Self-cross linking agents are reaction products of urea and formaldehyde or melamine and formaldehyde. Some of these reaction products are also methylated with methanol. They are used mainly for resin finish of regenerated cellulosic fiber and more generally applied for stiffening finish.

Reactant cross linking agents are generally reaction products of urea, glyoxal and formaldehyde. Some of the reaction products may also be modified with an alcohol. Reactant cross linking agents are suitable for resin finishing woven fabric composed of cellulosic fibers and blends of cellulosic fibers with synthetic fiber. A new generation of resin finishes have a low level of free formaldehyde on the fabric. These cross linking agents are nevertheless very reactive, particularly with the addition of magnesium chloride as a catalyst, thereby leading to higher production speeds and lower production costs.

In an embodiment, the low temperature curing resin comprises a reactant cross linking agent. Preferably, the reactant cross linking resin contains little uncombined formaldehyde (for example, less than about 0.1%) and methanol. The amount of uncombined formaldehyde in the cross linking resin is less than about 170 ppm, preferably about 80 ppm to about 160 ppm, more preferably about 80 ppm to about 150 ppm, and more preferably about 90 ppm to about 140 ppm. In another embodiment the cross linking resin may be substantially free of formaldehye.

In a preferred embodiment of the present invention, the reactant cross linking agent may be a heterocyclic reaction product of urea, glyoxal and formaldehyde modified with methanol, such as dimethyl dihydroxy ethyl urea or a modified dihydroxy ethylene urea. For example, the resin may be KNITTEX® RCT (modified dihydroxy ethylene urea) from Huntsman, FIXAPRET® AP from BASF, or the like, or a combination thereof. Other potential reactant crosslinking resins include FIXAPRET® ECO (modified dimethyloldihydroxyethylene urea) or FIXAPRET® CP (1,3-dimethylol-4,5-dihydroxyethylene urea) both available from BASF. For a fabric that is substantially free of formaldehyde an exemplary reactant cross linking resin is FIXAPRET®NF (an aqueous solution of 1,3-dimethyl-4,5-dihyroxyethylene urea) available from BASF of KNITTEX®FF (aqueous solution of a modified dinhydroxy ethylene urea, free of formaldehyde) or KNITTEX®FFRC (pre-catalyzed aqueous solution of a modified dihydroxy ethylene urea, free of formaldehyde), both available from Huntsman.

By using a resin with a reactant cross linking agent, very low levels of formaldehyde or no detectable formaldehyde, remain on the fabric after completion of the curing step and yet a high degree of finishing is achieved with an acceptable loss in fiber strength. Curing using a reactant cross linking agent in combination with dry cross linking replaces conventional moist curing, as in step 8*b* of FIG. 1, and achieves better performance ratings than conventional moist curing.

Any catalyst known for use in this art may be used in the low temperature curing resin, or as a separate component that may be added during resin application. The catalyst is used to control the reaction. Preferably, the catalyst works such that the reaction may be carried out at about 130° C.-180° C. within usual curing times (i.e., within several minutes when using a curing machine and within several seconds when using a stenter). If a pre-catalyzed resin is used no catalyst is needed. In certain embodiments, the catalyst may be magnesium chloride or magnesium chloride supplemented with organic acids. In step 7*a*of FIG. 2, the catalyst used is magnesium chloride ($MgCl_2$). Another exemplary catalyst is magnesium sulfate. If desired, a co-catalyst may also be employed such as sodium fluoroborate.

Additives may be included in the low temperature curing resin to partly or completely offset any adverse effects (such as loss in tear strength or abrasion resistance) imparted by the cross linking agent. Any additive known for use in resins may be used. For example, the additive may be a softening agent or a smoothening agent added to improve handle, but also to compensate for any loss in tear strength and abrasion resistance. Exemplary softening and smoothing agents include silicon based softeners such as RUCOFIN® GPS and RUCOFIN®GWA, both available from Rudolf Chemie.

When present, the surfactant in the low temperature curing resin acts as an emulsifier, wetting agent and stabilizer of the resin. It also ensures that the fabric wets rapidly and thoroughly during padding. Any surfactant known for use in resins may be used.

The surfactant acting as a wetting agent may be present in the low temperature curing resin, or added as a separate component during resin application. In a certain embodiment, any non-ionic surfactant which performs good wetting, emulsifying and stabilizing can be used as a wetting agent in accordance with the present invention. Preferably, the wetting agent should be free of be alkylphenol ethoxylate (APEO). In a preferred embodiment, the wetting agent used in a method of the present invention may be non-ionic APEO free surfactant, such as KIERALON® Jet B conc. from BASF, RUCOWET® VL from Rudolf, or the like, or a combination thereof.

In a certain embodiment, the low temperature curing resin is used in the amount of about 80 gpl to about 280 gpl, preferably about 100 gpl to about 220 gpl, more preferably about 110 gpl to about 200 gpl, and most preferably about 120 gpl to about 180 gpl. Those skilled in the art understand that glp is grams per liter.

In another certain embodiment, a stenter is used for resin application and a low temperature curing resin is applied in the amount of about 110 gpl to about 200 gpl, more preferably about 120 gpl to about 180 gpl, in combination with a catalyst in the amount of about 15 gpl to about 30 gpl, more preferably about 22 gpl, polyethylene dispersion in the amount of about 10 gpl to about 30 gpl, more preferably about 20 gpl, and a wetting agent in the amount of about 0.25 gpl to about 4 gpl, more preferably about 1 gpl, at a PU of about 65%. In addition, a nano particle elastomer may be added during resin application in the amount of about 15 gpl to about 25 gpl, more preferably about 15 gpl.

The type and amount of low temperature curing resin is selected based on % pick up (PU) of the fabric on the stenter; desired durable press rating after repeated washes; tensile, tear and seam slippage results; and desired color. The amount of time and temperature may also be adjusted for specific fabric, weave, blend and construction.

During dry cross linking, the low temperature curing resin, which has been applied to the fabric, reacts with the fibers of the fabric, e.g., cellulose, at a certain temperature and time in the stenter. In contrast to the prior art, the method of the present invention eliminates the moisture cross linking step and instead incorporates a continuous curing step involving dry cross linking, without the addition of harsh chemicals, such as sulfuric acid, and which is complete in less than about 1 hour, preferably less than about 30 minutes, more preferably less than about 5 minutes, and more preferably less than about 1 minute, instead of in 24 hours. Thus, the method of the present invention is significantly faster than conventional LAMC processing and advantageously does not require the use of harsh sulfuric acid.

By using the curing step of the present invention, less formaldehyde is used and less formaldehyde is absorbed into the fabric than in conventional LAMC processing and yet the finished product, i.e., the non-iron fabric, has at least the same flexibility and dimensional stability as achieved by conventional processes. With the method of the present invention, it is possible to produce a non-iron fabric with a formaldehyde content (i.e., amount of residual free formaldehyde on the finished non-iron fabric) less than about 25 ppm, preferably, less than about 24 ppm, more preferably, less than about 23 ppm, more preferably, about 22 ppm or less, more preferably, less than about 20 ppm, more preferably, less than about 18.5 ppm, more preferably, less than about 17.5 ppm, more preferably, less than about 16.0 ppm, and most preferably less than about 14.5 ppm.

Washing after curing is substantially similar to the washing step described in the background section (e.g., step 9 of FIG. 1), except that the parameters and details differ as follows. In certain embodiments, washing is performed at a speed of about 20 m/min to about 40 m/min, preferably about 25 m/min to about 35 m/min, and more preferably about 30 m/min; at a temperature of about 25° C. to about 55° C., preferably about 30° C. to about 50° C., and more preferably about 35° C. to about 45° C., and most preferably about 40° C. Washing may be performed in any machine conventionally used in the art for washing fabric or by hand, though, in certain embodiments, to improve washing efficiency, the washing machine has eight chambers, with each chamber containing 25 meter cloth content, and runs at the speed of 40 meter/mins.

Softening after washing is substantially similar to the softening step described in the background section including the incorporation of a top finishing coat (e.g., step 10 of FIG. 1), except that the parameters and details differ as follows.

In an embodiment, the elastomer is a macro emulsion, is a nano particle size and contains the polyethylene dispersion. An exemplary polyethylene dispersion is SILIGEN®PEP available from BASF, while exemplary macro emulsion elastomers may be RUCOFIN®GSP or ROCOFIN®GWA, both available from Rudolf Chemie. In a preferred embodiment, the elastomer is a macro emulsion and is used in the amount of about 2 gpl to about 20 gpl, more preferably in the amount of about 5 gpl to about 15 gpl, and most preferably in the amount of about 10 gpl. The wetting agent used in softening may be any non-ionic surfactant which performs good wetting, emulsifying and stabilizing, as described above in the resin application step. AS previously mentioned, an exemplary softening agent may be RUCOWET® VL available from Rudolf Pakistan.

In a certain embodiment, a stenter is used for softening and a top finishing coat is applied comprising: about 5 gpl to about 15 gpl, preferably about 10 gpl, of macro emulsion elastomer; about 10 gpl to about 30 gpl, preferably about 20 gpl, of polyethylene dispersion; and about 0.25 gpl to about 4 gpl, preferably about 1 gpl, of a wetting agent, at a PU of about 65%.

In a certain embodiment, softening is performed at a speed of about 40 m/min to about 60 m/min, preferably about 40 m/min to about 55 m/min, more preferably about 45 m/min to about 55 m/min, and most preferably about 50 m/min; at a temperature of about 105° C. to about 135° C., preferably about 110° C. to about 130° C., more preferably about 115° C. to about 125° C., and most preferably about 120° (C.

A next step is massaging using an air blast textile finishing machine. Massaging means processing and softening a fabric by a chemical-free, air-only transport system.

An air blast textile finishing machine is any machine capable of massaging the fabric as detailed herein. In a preferred embodiment, the air blast textile finishing machine may be an AIRO® (or Biancalani AIRO®), which is made and sold by Biancalani srl, Prato, Italy, or any machine that operates in the same manner and performs the same function as the AIRO®. An example of such a machine is described in U.S. Pat. No. 4,766,743, the disclosure of which is incorporated by reference in its entirety herein.

The air blast textile finishing machine massages the fabric to improve the hand feel and look of the fabric with considerable effect on quality. The air blast textile finishing machine works by applying an air treatment, more specifically, by combining an air-only fabric transport system and high speed crashing of the fabric against a grid. The fabric, in rope form (rather than in open width), is driven by an intensive air flow and accelerated without any tension inside processing tubes, then ejected against an impact grid positioned, for example, at the rear of the machine, where the accumulated kinetic energy is discharged. After falling onto a coated surface, for example, coated with Teflon, the fabric flows or is transported to the front of the treatment vat and is then guided by a roller to the beginning of a new cycle.

The air fabric transport system of the air blast textile finishing machine keeps the fabric safe from any form of mechanical crease or abrasion and concurrently delivers a strong and delicate action, without any friction or introduction of defects. As the fabric is continuously massaged by air inside the tubes, the fibers swell and the fabric moves from rope form to open width upon exit from the machine. Moreover, the air enveloping the rope form prepares the fabric for the intensive air flow and acceleration in the machine that will cause swelling and improve the handle of the fabric. In a certain embodiment, the fabric is opened by the air flow (i.e., it goes from rope form to open width) as it is ejected from the tubes, thereby preventing the formation of marks. In other embodiments, the fabric undergoes a strong and controlled crash against the impact grid, which delivers a soft and silky hand feel to the fabric. Use of the air blast textile finishing machine improves the hand feel of the finished fabric by mechanical, chemical-free, softening. This is accomplished without the need of further processing with steam application, intensive steaming treatments, polymerization of resin-treated fabric, or compaction and relaxation.

An air blast textile finishing machine has been known for use in Aero finishing, but has not conventionally been used in the process of finishing non-iron fabric because the machine is not suitable for resin application in bulk. While the air blast textile finishing machine can be used for polymerization and cross linking, the productivity would be decreased and there would be substantial variability in durable press rating between batches as well as loss of strength across the length of the fabric. However, when softness, e.g., hand feel, of the fabric is important along with a high durable press rating, i.e., 2.5 or higher, the air blast textile finishing machine helps to break down the body of fabric that has been treated with a resin and produce a draped and softer feeling fabric. Further, it was found after much experimentation that with mercerization, resin application and treatment with the air blast textile finishing machine, as shown, for example, in the improved method of FIG. 2, a non-iron fabric can be made which is better and more sustainable than one made according to conventional LAMC processing.

In certain embodiments, the fabric is massaged by an air blast textile finishing machine for about 5 minutes to about 50 minutes, preferably for about 10 minutes to about 40 minutes, more preferably for about 15 minutes to about 30 minutes, and most preferably for about 18 minutes to about 25 minutes. In a preferred embodiment thereof, the fabric may be massaged for about 20 minutes. In another embodiment, the temperature of the air blast textile finishing machine is set to about 20° C. to about 60° C., preferably about 30° C. to about 50° C., more preferably about 35° C. to about 45° C., and most preferably about 40° C. One of ordinary skill in the art would understand how to adjust these parameters as needed based on the detailed information provided herein for the type, size and construction of the fabric being processed.

Width setting optionally follows massaging and is substantially similar to the width setting step described above. More particularly, however, since the fabric is in rope form and may be crushed during the step of massaging in the air blast textile finishing machine, width setting after massaging using an air blast textile finishing machine serves to smooth, finish and set the width of the fabric in preparation for the next step, e.g., sanforizing. Width setting after massaging the fabric using an air blast textile finishing machine may be performed at a temperature of about 120° C. to about 160° C., preferably about 125° C. to about 155° C., and more preferably about 135° C. to about 145° C.

Sanforizing in accordance with the present invention is substantially similar to the sanforizing step described in the background section (e.g., step 11 of FIG. 1), except that the parameters and details differ as follows. In an embodiment of the invention, sanforizing is performed at a speed of about 40 m/min to about 60 m/min, preferably about 45 m/min to about 55 m/min, and more preferably about 50 m/min, and at a temperature of about 75° C. to about 95° C., preferably about 80° C. to about 90° C., and more preferably about 85° C.

One of ordinary skill in the art would understand how to adjust the parameters set forth above, as needed for the type, size and construction of the fabric being processed in view of the details provided herein. This is due, in part, to different pick up of the structure of the fabric. For example, twill and dobby weaves have a greater pick up than poplin and oxford weaves; and with respect to curing, more dense and compact fabrics require higher impregnation time and lower temperatures to achieve an optimal result.

A second embodiment of the invention is directed to a non-iron fabric comprising a cellulosic material having a durable press rating of at least about 3.0; and a formaldehyde content of less than about 25 ppm. Preferably, the durable press rating is at least about 3.5. The details noted above are the same for the second embodiment of the invention as for the first embodiment of the invention.

In an embodiment thereof, the non-iron fabric has a durable press rating of at least about 3.5 after 3 washes and, preferably, a durable press rating of at least about 3.5 after 5 washes. In another embodiment, the non-iron fabric has a formaldehyde content of less than about 24 ppm, preferably, less than about 23 ppm, more preferably, about 22 ppm or less, more preferably, less than about 20 ppm, more preferably, less than about 18.5 ppm, more preferably, less than about 17.5 ppm, more preferably, less than about 16.0 ppm, and most preferably less than about 14.5 ppm.

A third embodiment of the invention is directed to a non-iron garment made from a non-iron fabric comprising a cellulosic material having a durable press rating of at least about 3.0; and a formaldehyde content of less than about 25 ppm. In an embodiment, the durable press rating of the non-iron garment is at least about 3.5, and preferably about 4.0. The details noted above are the same for the third embodiment of the invention as for the first embodiment of the invention.

In an embodiment thereof, the non-iron garment has a durable press rating of at least about 3.5 after 3 washes and, preferably, a durable press rating of at least about 3.5 after 5 washes. In another embodiment, the non-iron garment has a formaldehyde content of less than about 24 ppm, preferably, less than about 23 ppm, more preferably, about 22 ppm or less, more preferably, less than about 20 ppm, more preferably, less than about 18.5 ppm, more preferably, less than about 17.5 ppm, more preferably, less than about 16.0 ppm, and most preferably less than about 14.5 ppm.

A fourth embodiment of the invention is directed to a non-iron fabric made by the improved method described above.

The following examples are intended for illustration purposes only, and should not be construed as limiting the scope of the invention in any way.

Examples

Durable Press Rating

A test was conducted to compare the durable press (DP) rating of six different fabrics made by a process of the present invention as shown in FIG. 2, after both three washes and after five washes. The fabrics varied by construction, by weave, weight and color. The washes were performed using Tide detergent at a normal cycle at 41° C., followed by drying at tumble dry medium, 4 lb. load. The durable press rating was tested according to AATCC-124.

TABLE 1

SMOOTHNESS APPEARANCE (DP) REPORT

| Sample I.D | Color | Fabric manufacturer | Construction | Weave | No of washes | DP Rating |
|---|---|---|---|---|---|---|
| 3k0814 | Royal plum 552 | Beximco | 40*40/130*88 | PLAIN | 3 | 3.5 |
| 3k0812 | Dk. Indigo | Beximco | 40*40/130*80 | PLAIN | 5 | 3.5 |
| 3k0811 | Glacier 997 | Beximco | 40*40/130*80 | PLAIN | 3 | 3.5 |
| | Glacier 997 | Beximco | 40*40/130*80 | PLAIN | 3 | 3.5 |
| 3k0813 | Soft Blue 459 | Beximco | 40*40/130*88 | Dobby | 3 | 3.5 |
| 3k0815 | Soft Lilac 556 | Beximco | 40*40/130*88 | Dobby | 3 | 3.5 |
| 3K0810 | Tulip 531 | Beximco | 40*40/130*80 | 2/1 S Twill | 3 | 3.5 |
| | Royal plum 552 | Beximco | 40*40/130*88 | PLAIN | 3 | 3.5 |
| 3k0812 | Dk. Indigo | Beximco | 40*40/130*80 | PLAIN | 5 | 3.5 |
| 3k0813 | Soft Blue 459 | Beximco | 40*40/130*88 | Dobby | 5 | 3.5 |
| 3K0810 | Tulip 531 | Beximco | 40*40/130*80 | 2/1 S Twill | 5 | 3.5 |

As shown in Table 1, after three washes and after five washes, each fabric maintained a durable press rating of 3.5.

Formaldehyde Content

A test was conducted to compare the formaldehyde content of a fabric processed according to the present invention to the formaldehyde content of a fabric processed according to conventional liquid ammonia moisture-cure processing. The fabrics were both 100% cotton.

TABLE 2

COMPARISON OF FORMALDEHYDE CONTENT IN FINISHED FABRICS

| Color | Fabric Manufacturer | Construction | Weave | Formaldehyde (ppm) |
|---|---|---|---|---|
| Turquoise Green | Beximco (alternative process) | 130 × 80/ 40 × 40 | Dobby | 22.0 |
| Dark Navy | Lu Thai (LAMC) | 144 × 80/ 50 × 50 | Chambray | 25.20 |

As demonstrated by the results in Table 2, fabric finished with the process according to the present invention has a lower formaldehyde content than fabric finished with liquid ammonia moisture-cure processing.

While the disclosure has been described above with reference to specific embodiments thereof, it is apparent that many changes, modifications, and variations can be made without departing from the concept disclosed herein. Accordingly, it is intended to embrace all such changes, modifications, and variations that fall within the spirit and broad scope of the appended claims.

What is claimed is:

1. A method of finishing a non-iron fabric comprising the steps of:

a) mercerizing a fabric without liquid ammonia to obtain a mercerized fabric;

b) curing the mercerized fabric, including the steps of:

applying low temperature curing resin to the mercerized fabric to obtain a resin-treated fabric; and dry cross linking the resin-treated fabric to obtain a cured fabric; and c) massaging the cured fabric using an air blast textile finishing machine to produce the non-iron fabric, further comprising the following steps after the massaging step c):

width setting the non-iron fabric to obtain a width set fabric, and sanforizing the width set fabric.

2. The method of claim 1, wherein the non-iron fabric is mercerized with caustic soda.

3. The method of claim 1, wherein the low temperature curing resin comprises a reactant cross linking agent.

4. The method of claim 3, wherein the reactant cross linking agent includes a low amount of uncombined formaldehyde or is formaldehyde free.

5. The method of claim 1, wherein the non-iron fabric has a durable press rating of at least about 2.5.

6. The method of claim 5, wherein the non-iron fabric has a durable press rating of at least about 3.0.

7. The method of claim 6, wherein the non-iron fabric has a durable press rating of at least about 3.5.

8. The method of claim 1, wherein the non-iron fabric has a durable press rating of about 3.5 after 3 washes.

9. The method of claim 1, wherein the non-iron fabric has a durable press rating of about 3.5 after 5 washes.

10. The method of claim 1, wherein the non-iron fabric has a formaldehyde content of less than about 25 ppm.

11. The method of claim 10, wherein the formaldehyde content is less than about 24 ppm.

12. The method of claim 1, wherein curing is performed in two steps using a stenter.

13. The method of claim 1, wherein the curing is continuous and completed in less than 24 hours.

14. The method of claim 1, further comprising any one of the following steps before mercerizing step a):

i) singeing a fabric to obtain a singed fabric;

ii) desizing the singed fabric to obtain a desized fabric;

iii) impregnating the desized fabric to obtain an impregnated fabric;

iv) hot washing the impregnated fabric to obtain a hot-washed fabric; and v) width setting the hot-washed fabric.

15. The method of claim 1, further comprising any one of the following steps after curing step b) and before massaging step c):

vi) washing the cured fabric to obtain a washed fabric; and vii) softening the washed fabric.

16. The method of claim 1, wherein the width set fabric further comprises a cellulosic material having a durable press rating of at least about 3.0; and a formaldehyde content of less than about 25 ppm.

17. The method of claim 16, wherein the width set fabric forms part of a non-iron garment having a durable press rating of at least about 3.0.

18. The method of claim 17, wherein the durable press rating is at least about 3.5.

19. The method of claim 17, wherein the durable press rating is at least about 3.5 after 3 washes.

20. The method of claim 17, wherein the durable press rating is at least about 3.5 after 5 washes.

21. The method of claim 17, wherein the formaldehyde content is less than about 24 ppm.

22. The method of claim 17, wherein the non-iron garment is substantially free of formaldehyde.

* * * * *